United States Patent [19]

Dieter

[11] Patent Number: 5,070,810

[45] Date of Patent: Dec. 10, 1991

[54] SHIELD FOR WHEELS USING TENSIONING MEANS

[76] Inventor: Maron S. Dieter, 424 Main Street, Beaverton, Ontario, Canada, L0K 1A0

[21] Appl. No.: 603,308

[22] Filed: Oct. 25, 1990

Related U.S. Application Data

[63] Continuation-in-part of Ser. No. 381,786, Jul. 19, 1989, abandoned.

[30] Foreign Application Priority Data

Dec. 6, 1988 [CA] Canada ..... 585147

[51] Int. Cl.[5] ..... B05C 21/00

[52] U.S. Cl. ..... 118/505

[58] Field of Search ..... 118/504, 505; 24/274 R, 24/279, 280, 272; 403/344; 51/310, 311, 312, 262.1, 274; 427/282; 74/89.17, 422

[56] References Cited

U.S. PATENT DOCUMENTS

| | | | |
|---|---|---|---|
| 1,775,940 | 9/1927 | McBride | 74/422 |
| 1,816,197 | 7/1931 | Ruemelin | 24/279 |
| 2,081,666 | 5/1937 | Gunn | 118/505 |
| 2,423,195 | 7/1947 | Longden | 24/279 |
| 2,716,391 | 1/1954 | Nonemaker et al. . | |
| 2,726,634 | 7/1954 | Horner . | |
| 2,835,222 | 5/1958 | Hall et al. . | |
| 2,930,348 | 8/1957 | Fannin . | |
| 2,996,041 | 5/1959 | Carpenter et al. . | |
| 3,001,509 | 5/1959 | Carpenter et al. . | |
| 3,007,401 | 10/1959 | Kordenbrock . | |
| 3,141,794 | 3/1961 | Horner . | |
| 3,192,896 | 1/1962 | Irving . | |
| 4,549,591 | 10/1985 | Hyggen | 74/422 |
| 4,628,858 | 12/1986 | King et al. . | |
| 4,811,991 | 3/1989 | Moreno | 118/505 |

FOREIGN PATENT DOCUMENTS

| | | | |
|---|---|---|---|
| 0364342 | 4/1990 | European Pat. Off. | 118/504 |
| 3516892 | 11/1986 | Fed. Rep. of Germany | 118/504 |
| 1256422 | 11/1961 | Italy | 24/274 |
| 307069 | 2/1929 | United Kingdom | 24/279 |

*Primary Examiner*—Richard V. Fisher
*Assistant Examiner*—Brenda Lamb

[57] ABSTRACT

A shield for use with vehicle wheels and having an annular shield wall, with an annular inner flange defining a generally circular inner opening to embrace a wheel rim and an outer edge and two ends, and having in section a shallow flared shape and tensioning devices on the two ends which can be interconnected and which can progressively draw these two ends together into overlapping relationship in overlying planes, tensioning of the two ends progressively increasing the flaring angle of the annular shield wall, and at the same time progressively reducing the diameter of the generally circular inner opening to cause the inner flange to clamp around the wheel rim.

5 Claims, 3 Drawing Sheets

SHIELD FOR WHEELS USING TENSIONING MEANS

This application is a continuation in part of U.S. application Ser. No. 07/381,786 filed Jul. 19, 1989, inventor Dieter Maron, A SHIELD FOR WHEELS, now abandoned.

FIELD OF THE INVENTION

The invention relates to a shield for use when treating vehicle wheels.

BACKGROUND OF THE INVENTION

The task of treating vehicle wheels, when already mounted with tires, requires the operator to mask the tires before cleaning or spraying, or sand blasting the wheels, so as to avoid damaging the tires.

In the past various shield devices have been proposed, which could be attached to the tires, to shield them. Examples are shown in U.S. Pat. No. 2,716,391 and 3,007,401. These devices were intended to fit around the rim of the wheel, and cover the side wall, or a portion thereof of the tire.

Other devices have been proposed which clip on to the tire itself such as shown in U.S. Pat. No. 3,141,794 for example.

These devices have suffered from various disadvantages. Some were not completely effective. In some cases, the mask did not make a tight fit around the rim, and some paint or other material could leak through, and impinge on the tire side wall. Other such devices were somewhat difficult to attach and might require two men working together to fit each shield in position.

All of these devices have suffered from the defect that vehicle tires have various different profiles around the side wall. Some tires bulge more than others. This is particularly true of, for example radial tires. Such tires tend to bulge over the rim of the wheel, and make it difficult to fit a shield in position by hand.

The profile of the side wall of the tire causes problems not merely with the fitting of a shield around the wheel rim, but also in the operation of a tensioning device for tensioning the shield around the rim.

BRIEF SUMMARY OF THE INVENTION

With a view to overcoming these various disadvantages the invention comprises a shield for use in association With vehicle wheels and, in turn, comprising an annular shield wall having an annular inner flange defining a generally circular inner opening adapted to embrace a wheel rim and an outer edge, and defining two ends, and said shield wall defining in section a shallow flared shape, with said inner flange set an an angle to said shield wall, and a tensioning device on each of said ends being interengageable and co-operable to progressively draw said two ends together into overlapping and overlying relationship, whereby to progressively force said inner flange between said wheel rim and said tire and progressively increase the flaring angle of said shield wall, and to progressively reduce the diameter of said generally circular opening.

The invention further provides a shield having the foregoing advantages, and including operating means for operating said tensioning devices, said operating means being located along an axis at an angle to said shield wall, thereby giving access thereto from a point outwardly of said outer rim of said wall.

The invention further provides a shield having the foregoing advantages and further including a rack plate on one end of the shield and a rack housing with a rotatable pinion on the other end of the shield interengageable with the rack to draw the two ends together, and a ratchet clamping means interengageable with the rack plate, to secure it in position.

The various features of novelty which characterize the invention are pointed out with more particularity in the claims annexed to and forming a part of this disclosure. For a better understanding of the invention, its operating advantages and specific objects attained by its use, reference should be had to the accompanying drawings an descriptive matter in which there are illustrated and described preferred embodiments of the invention.

IN THE DRAWINGS

DESCRIPTION OF A PREFERRED EMBODIMENT

Figure 1:
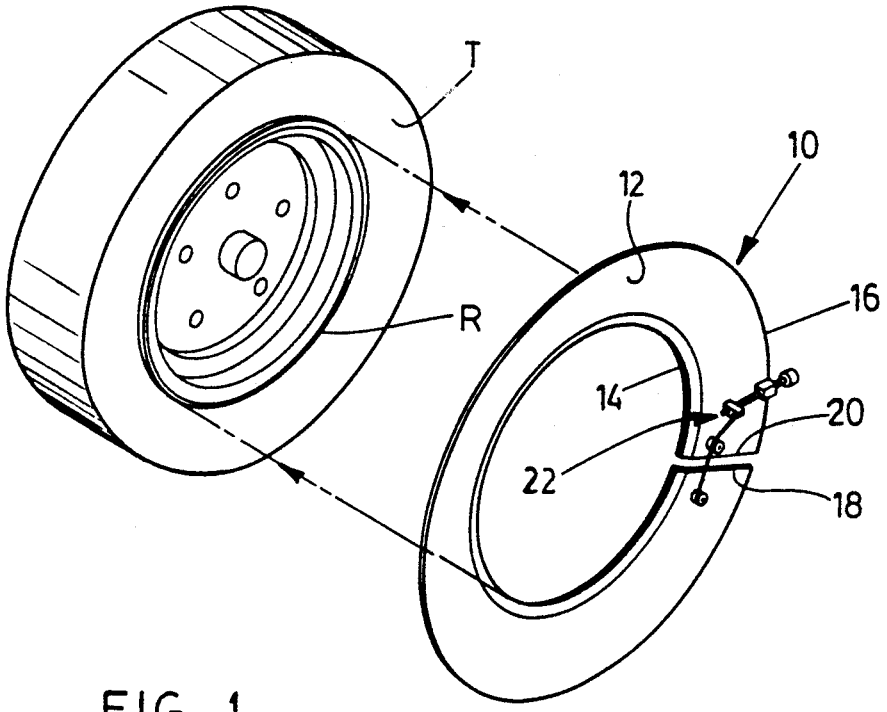
FIG. 1 is a perspective illustration of a shield in accordance with the invention.
Figure 2:
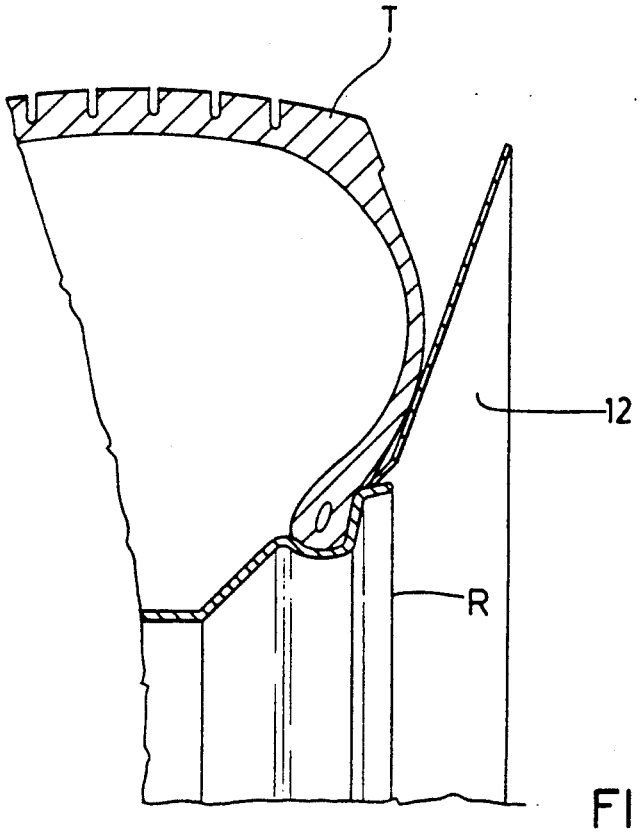
FIG. 2 is a section showing the shield when applied to a wheel.

Referring to FIGS. 1 and 2, the shield in accordance with the invention will be seen to be illustrated in the form of a shield 10, consisting of an annular wall 12, enclosing a generally circular opening 14 and having and an outer edge 16. Two ends 18 and 20 are located adjacent to one another.

Figure 3:
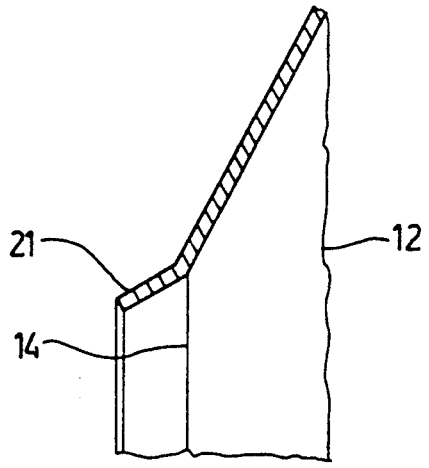
FIG. 3 is an enlarged partial section of the shield

As shown in FIGS. 2 and 3, the wall 12 is formed with a shallow flared shape. A flange 21 extends around the inner edge of the wall 12 and is angled thereto, at a somewhat steeper cone angle. The flange 21 may be in the form of a conical flange, or may be a trumpet shape in section.

At each of the ends 18 and 20, tensioning devices indicated generally as 22 and 23 are provided.

Figure 4:
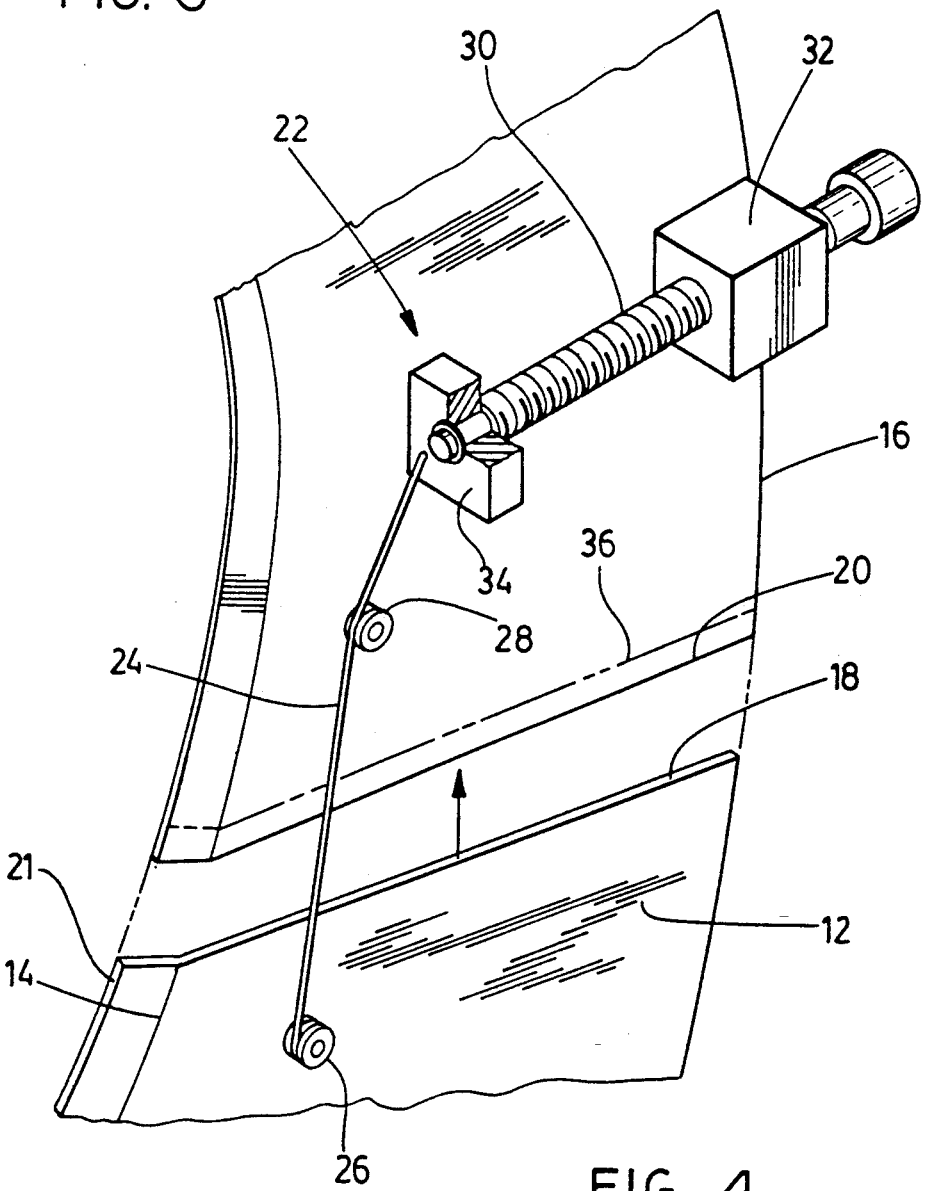
FIG. 4 is a greatly enlarged detail of the tensioning device.

As shown in more detail in FIG. 4, the tensioning devices comprise, in this embodiment of the invention, a flexible tension element or cable 24, secured by stud 26 to end 18. A bearing or pulley 28 is located on end 20, around which the cable 24 may run. The tension operating means includes a tensioning screw 30, located in a bracket 32, and attached to the free end of the cable, by any suitable rotatable coupling 34.

The screw 30 is located more or less radially relative to the centre of the shield wall, although it need not be precisely radial. It may be operated by a screwdriver, or socket wrench or the like. It will be observed that the operation of whatever tool is used to operate the screw takes place exteriorally or radially outwardly of the outer edge 16 of the wall 12.

It will also be understood that the screw 30 may be operated by some other means such as a typical allen key of "L" shaped configuration, so that the plane of rotation of the handle of the allen key, socket wrench, or the like takes place in a plane parallel to but spaced from the plane of the side wall of the shield.

The tension element or cable 24, between the two ends 18 and 20, lies on an axis which is a chord segment within outer edge 16.

The operation of the device is best understood with reference to FIG. 4 and FIG. 1.

The tension screw 30 is first of all slacked off, so that the flange 21 can be fitted around a vehicle wheel rim R. The tire T usually bulges outwardly relative to the rim R. Once the flange 21 is fitted around the rim R, the operator can then simply rotate the screw 30 progressively tensioning the cable 24. This will have the effect of pulling the two ends 18 and 20 together into increasingly overlapping and overlying relation as shown at 36 in FIG. 4. As this takes place, the inner flange 21 is drawn tightly around the vehicle rim R. It also has the effect of progressively increasing the flaring angle of the wall 12 of the shield 10. This thus provides a firm secure grip of the flange 21 all around the vehicle wheel rim R and excludes the entry of any material to be used such as cleaning materials, spray paint or sand, around the rim which might otherwise disfigure or indeed damage the tire itself. The inner flange 21 is thus forced progressively deeper and deeper between the wheel rim and the side wall of the tire, so as to make a good liquid tight fit.

Figure 5:
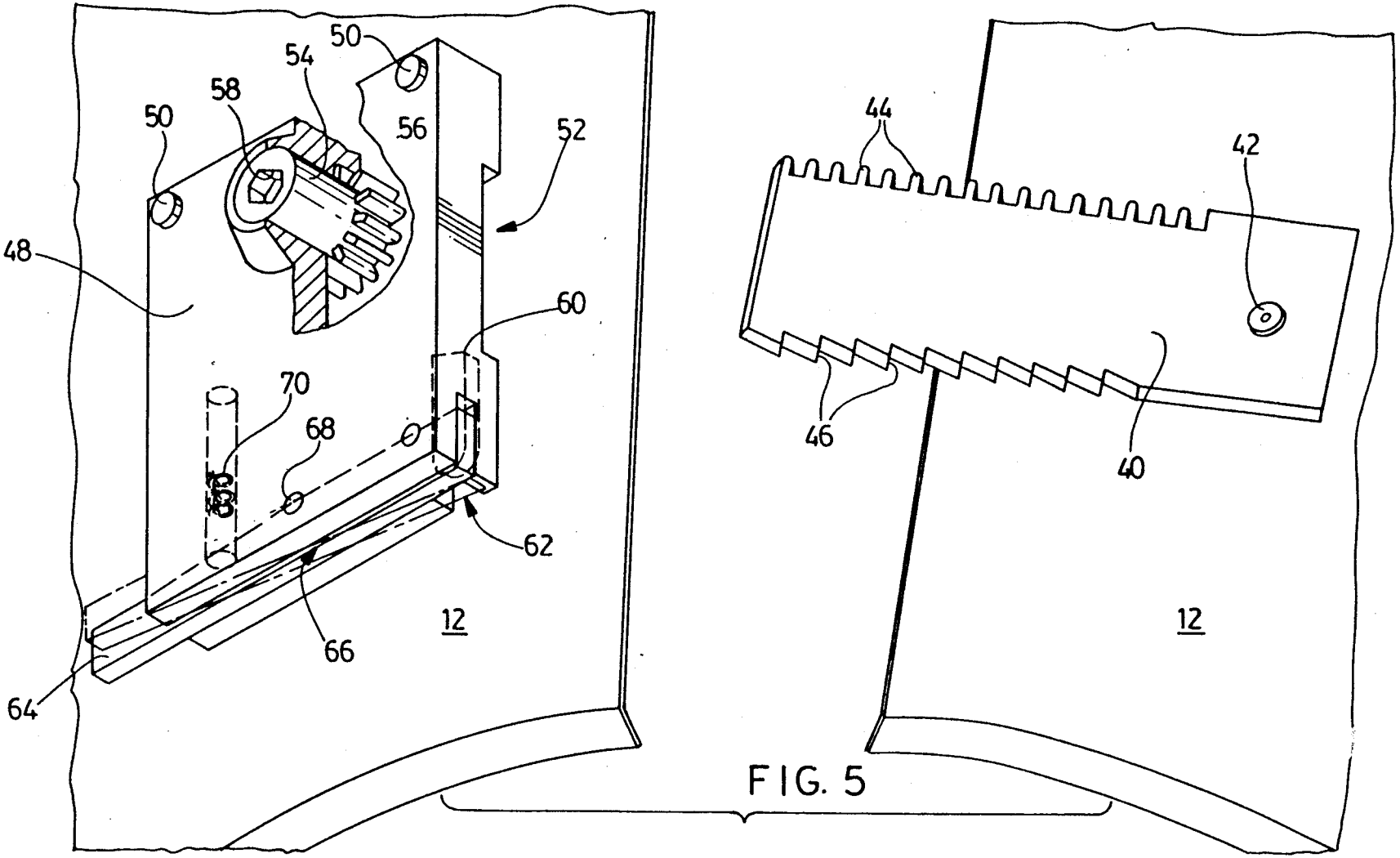
FIG. 5 is a perspective cut-away illustration of an alternate embodiment of the invention.

In accordance with a further embodiment of the invention as shown in FIG. 5, provision may be made for a rack and pinion form of tensioning devices as shown in FIG. 5.

In that embodiment, a rack plate shown generally as 40 is attached, for example, by a rivet 42 to one end of the shield wall 12. Rack plate 40 is formed along its outer edge with a series of rack tees 44. Plate 40 is formed along its inner edge with a series of saw teeth or serrations 46.

On the other free end of wall 12, a rack housing 48 is provided, being secured to plate 12, for example, by bolts or rivets 50, only two of which are illustrated for the sake of simplicity.

Rack plate 48 is formed with a generally rectangular recess 52 extending therethrough from one side to the other, being sized and adapted to receive the rack plate 40 therein.

A pinion gear wheel 54 is rotatably mounted in rack plate 48 having teeth 56 for engaging teeth 44, and having for example an hexagonal recess 58 for reception of a suitable driving tool such as an allen key by means of which it may be rotated.

A detent tooth 60 is provided for engaging serrations 46. Tooth 60 is received in a generally channel shaped recess 62 in housing 48. Detent 60 is pivotally connected to one end of an operating lever 64. Operating lever 64 is pivotally mounted in a slot 66 by means of pivot 68.

A spring indicated generally as 70 is provided to urge the lever 64, so as to bias the detent 60 into an engagement with the serrations 46.

In operation, the shield is arranged with the two ends of the shield wall 12 apart from one another, and is then placed around the rim of a wheel. The two ends of the shield wall 12 are then manually forced together, causing a plate 40 to enter recess 52, and causing engagement of detent 60 with one of serrations 46.

By the operation of a suitable tool (not shown) the pinion 54 can then be rotated, so as to engage the teeth 44 on the rack plate 40 and draw the two ends of the shield wall 12 into overlapping relation. As soon as rotation of the tool is discontinued, the detent 60 will be operative to engage one of the serrations 46 and hold plate 40 in position.

In this way, the shield may easily be placed on wheel rim, and tightened up securely.

As soon as treatment of the wheel rim has been completed, then the detent 60 may be released simply by pressing lever 64 upwardly against spring 70. This will allow the two ends of the shield wall 12 to spring apart, releasing the shield from the wheel rim.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shield for use in association with vehicle wheels having wheel rims and tires thereon and comprising:

an annular shield wall enclosing a generally circular opening having an outer edge and defining two ends, and said shield wall defining in section a shallow flared shape extending away from said tire on said rim;

an inner flange on said shield wall extending around said opening and located at a cone angle relative to said shield wall oriented to fit between said tire and said rim;

tensioning devices on respective ends of said shield wall structured and arranged to progressively draw said two ends of said shield wall together into overlapping and overlying relationship, whereby to progressively increase the flaring angle of said shield wall away from said tire, and to progressively force said inner flange between said rim and said tire, and, tension operating means and means connecting same to said tensioning devices, said tension operating means being operable along an axis lying at an angle to said tension axis.

2. A shield as claimed in claim 1, and including tension operating means for operating said tensioning devices said tension operating means being located along an axis generally radial to said shield wall, thereby giving access thereto from a point outwardly of said outer rim of said wall.

3. A shield as claimed in claim 1, wherein said tensioning devices are attached between said two ends of said shield wall, and are operable to apply tension between said two ends, along a tension axis defining a segment of a chord lying within said outer edge of said shield wall.

4. A shield as claimed in claim 3, wherein said tensioning devices comprises a flexible tension element, one end of said element being fastened to one end of said shield wall, and the other end of said tension element extending around bearing means on said other end of said shield wall.

5. A shield as claimed in claim 4, wherein said tension operating means comprises a screwthreaded rod member connected to said other end of said tension element, and operable to progressively draw said tension element around said bearing means, whereby to draw said two ends of said shield wall together into overlapping relation.

* * * * *